United States Patent [19]

Karls

[11] Patent Number: 4,790,783

[45] Date of Patent: Dec. 13, 1988

[54] MARINE PROPULSION COMBINATION WITH IMPROVED COOLING

[75] Inventor: Michael A. Karls, Hilbert, Wis.

[73] Assignee: Brunswick Corporation, Skokie, Ill.

[21] Appl. No.: 115,697

[22] Filed: Nov. 2, 1987

[51] Int. Cl.[4] ..... B63B 1/00

[52] U.S. Cl. ..... 440/66; 440/88; 114/56

[58] Field of Search ..... 114/56, 57, 271, 274, 114/288, 290, 291, 357; 440/64, 79, 80, 88

[56] References Cited

U.S. PATENT DOCUMENTS

| | | | |
|---|---|---|---|
| 3,148,652 | 9/1964 | Canazzi | 114/56 |
| 3,330,239 | 7/1967 | Dornak | 114/56 |
| 4,193,369 | 3/1980 | Talamantes | 114/56 |
| 4,348,972 | 9/1982 | Parsons | 114/56 |
| 4,392,779 | 7/1983 | Bloemers et al. | 415/141 |
| 4,492,176 | 1/1985 | Arima | 114/56 |
| 4,636,175 | 1/1987 | Frazzell et al. | 440/88 |

*Primary Examiner*—Sherman D. Basinger
*Assistant Examiner*—Stephen P. Avila
*Attorney, Agent, or Firm*—Andrus, Sceales, Starke & Sawall

[57] ABSTRACT

Improved cooling is provided for a marine twin drive to prevent overheating, particularly during turns. It has been found that a low pressure path (46) exists along the strakes (24, 26) on the bottom surface (20) of the boat hull (12). Air can enter at the water surface (48) and be channeled longitudinally rearwardly along the bottom of the boat hull along the strakes and be ingested in the propulsion units (16, 18) which are generally longitudinally aligned with and rearward of the strakes. The low pressure path is eliminated by modified strake structure (**26*a*) occupying the space (44**) otherwise causing such low pressure path.

8 Claims, 2 Drawing Sheets

MARINE PROPULSION COMBINATION WITH IMPROVED COOLING

BACKGROUND AND SUMMARY

The invention relates to marine propulsion combination with improved cooling, to prevent over-heating.

Engine overheating in twin drive marine propulsion units is a long standing problem, particularly in,turns. Various prior attempts in solving the problem have centered around redesigns of the water inlet configuration structure. It has been found that this does not address the source of the problem. Furthermore, such redesigns of the water inlet configuration structure may be undesirable because of the tooling modifications required thereby, and because of increased drag in some designs.

In the present invention, it has been found that the source of the overheating problem is aerated water entering the water inlet, which in turn is due to the lifting strakes along the boat hull. The twin propulsion units are generally longitudinally aligned with respective strakes. It has been found that the configuration of the strakes creates a low pressure channel along the side of the strake. Air can enter at the water line and run along such low pressure path back to the end of the strake, where the air will spread in depth and width and provide a plume of aerated water. Since the propulsion units are in line with such strakes and plumes, the water inlets for the cooling system of the engine receive aerated water, reducing the volume of water entering the cooling system, thus resulting in engine overheating.

Improved cooling is provided by substantially diminishing the amount of aerated water supplied to the water inlets of the propulsion units.

In the present invention, the strake configuration is modified to eliminate the low pressure channel, to in turn eliminate the noted aerated water flow to the water inlets of the propulsion units. This in turn reduces the amount of air and increases the amount of water flowing into such inlets, to provide improved cooling.

DETAILED DESCRIPTION

Figure 1:
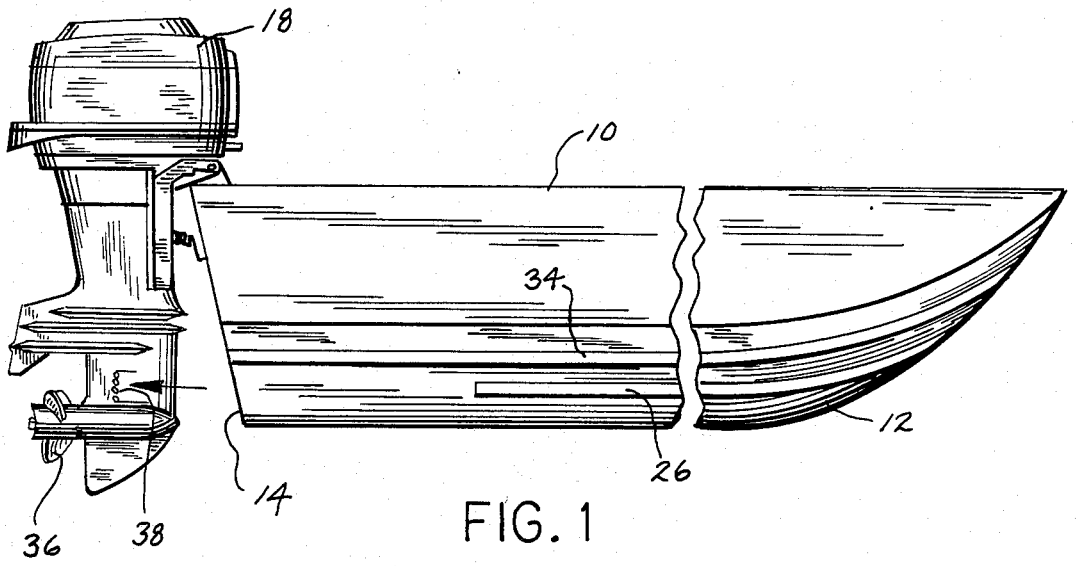
FIG. 1 is a side view of a boat with twin propulsion units.
Figure 2:
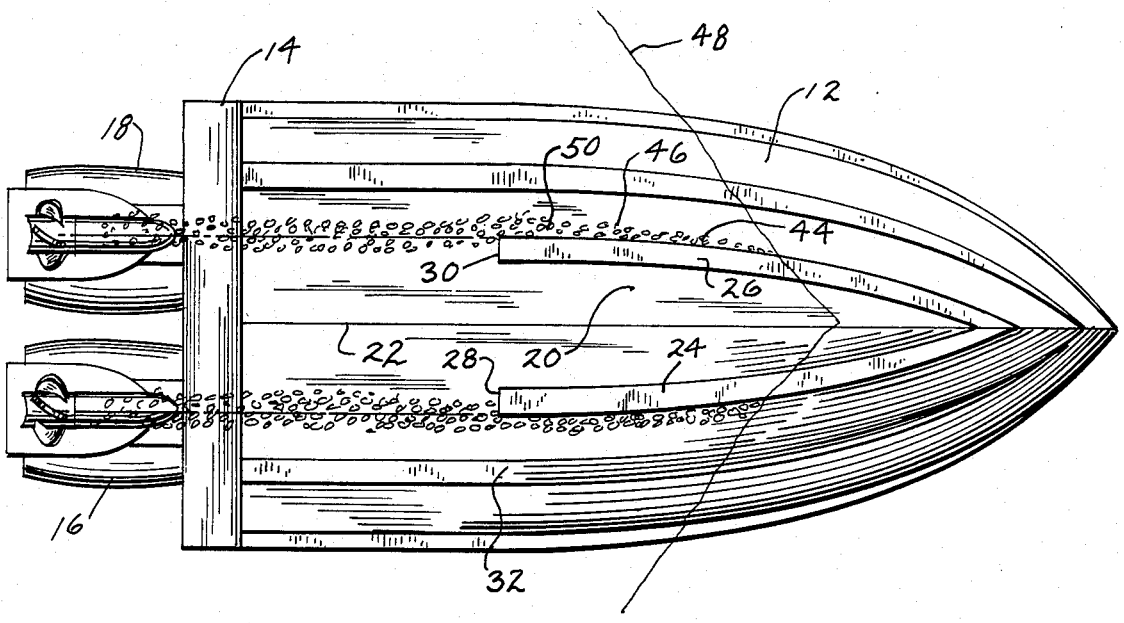
FIG. 2 PRIOR ART
FIG. 2 shows a bottom view of the boat of FIG. 1.

FIGS. 1 and 2 show a boat 10 having a hull 12 with a transom 14 at the stern end of the hull. A pair of propulsion units 16 and 18 are disposed on the transom The propulsion units may be outboard drive units as shown, or may be stern drive units. Boat hull 12 has a bottom surface 20 with a centerline 22 extending longitudinally therealong. The hull bottom is sloped laterally upwardly from centerline 22. A pair of lifting strakes 24 and 26 extend from the bow of the boat generally longitudinally rearwardly along the bottom of the hull and terminate at respective ends 28 and 30. Other lifting strakes such as 32 and 34 extend longitudinally rearwardly along the bottom of the hull all the way to transom 14.

Drive units 16 and 18 each have a submerged propeller, as shown at 36, and each has water intake ports, as shown at 38, on opposite sides of the depending submerged lower gearcase of the propulsion units, for which further reference may be had to U.S. Pat. Nos. 4,392,779 and 4,636,175, incorporated herein by reference. Water intake port 38 in propulsion unit 18 is generally longitudinally aligned with and rearward of strake 26. The water intake port in propulsion unit 18 is generally longitudinally aligned with and rearward of strake 24.

Figure 3:
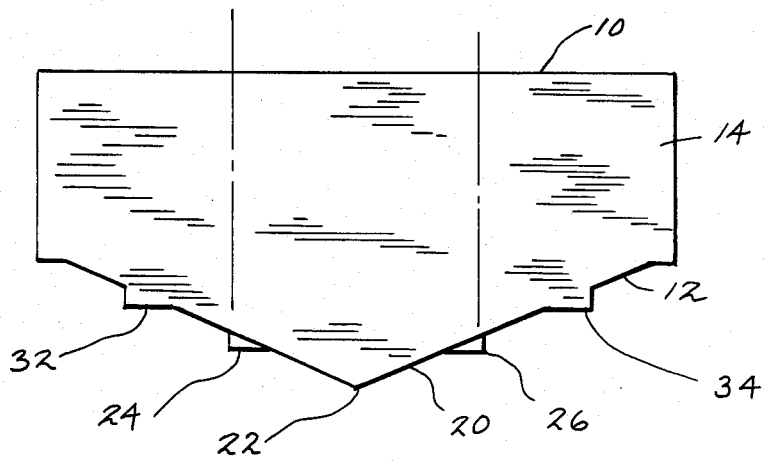
FIG. 3 PRIOR ART
FIG. 3 is an end view from the rear of the boat of FIG. 1.
Figure 4:
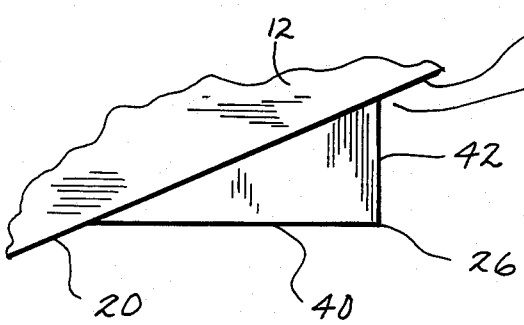
FIG. 4 PRIOR ART
FIG. 4 is an enlarged view of a portion of FIG. 3 showing a strake known in the prior art.

As shown in FIGS. 3 and 4, strake 26 has a generally horizontal bottom surface 40 extending laterally outward from the bottom surface 20 of the hull, and has a vertical side surface 42 extending upwardly from bottom surface 40 to the sloped bottom surface 20 of the hull.

It has been found that vertical side surface 42 of strake 26 creates a low pressure region 44 forming a path or channel 46, FIG. 2, extending longitudinally rearwardly along such strake vertical side wall. Air can enter such path at the water line 48 at the bow of the boat when the boat is running and follow such low pressure path rearwardly, as shown at air bubbles 50, to the water intake ports such as 38 on the propulsion unit. These air bubbles cause the ingestion of aerated water into such water intake ports of the propulsion units, and consequent overheating. The strakes may extend all the way rearwardly to the transom to provide such aerated water flow path, or the strakes may stop at ends 28 and 30, where the air will spread in depth and width and provide a plume of aerated water as shown at 52.

Figure 5:
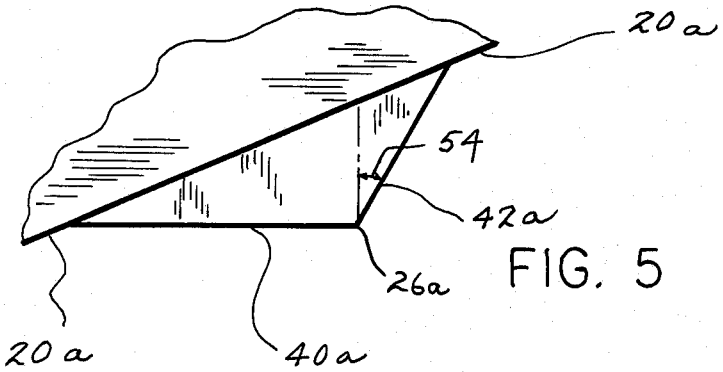
FIG. 5 shows modified strake structure in accordance with the invention.

In the present invention, FIG. 5, a strake 26*a* is provided with a horizontal bottom surface 40*a* extending laterally from the upwardly sloped hull bottom surface 20*a*, and with an upwardly sloped nonvertical side surface 42*a* occupying the space 44 otherwise adjacent vertical side surface 42 of strake 26, FIG. 4. Strake side surface 42*a* extends from bottom surface 40*a* laterally upwardly and outwardly to the hull bottom surface 20*a* at an acute angle 54 to the vertical. In the preferred embodiment, angle 54 is 30°, though other angles can be used if sufficient to occupy space 44 and eliminate low pressure path 46 and reduce ingestion of air in the water intake ports of the propulsion units, to prevent overheating. Angle 52 must be great enough to occupy a sufficient amount of space 44 to eliminate the low pressure path 46, but not so great as to significantly alter the lifting function of bottom surface 40*a* of the strake. It has been found that an angle of about 30° does occupy enough of space 44 to eliminate low pressure path 46, and yet does not significantly alter the lifting capability of bottom surface 40*a*. Other shapes of strake side surface 42*a* are also possible, for example concave or convex, as long as the shape of the surface is such that a sufficient amount of space 44 is occupied to eliminate the low pressure path 46, but not to significantly alter the lifting function of bottom surface 40*a* of the strake. The end 30, FIG. 2, of the strake is also modified to blend into the bottom surface of the hull to prevent cavitation otherwise caused by an abrupt end. Such modified end thus also has a nonvertical side wall. Strake 24 is comparable.

Strakes 24 and 26 are spaced laterally outward and substantially equidistance from centerline 22. The spacing between strakes 24 and 26 should never decrease as they extend longitudinally rearwardly, to prevent formation of a lo pressure path for air to follow.

During development and testing, a 31 foot Chriscraft Scorpion boat hull was modified to have a left strake in accordance with the configuration in FIG! 5; but the right strake was unchanged, to thus have the configuration of FIG. 4. The propulsion units were twin mounted V200 Mercury outboards with production powerheads and production gearcases. The normal safe operating range for the cooling water pressure at the powerhead of these units is between 15 and 30 psi (pounds per square inch). During a left turn, it was observed that the cooling water pressure in the left propulsion unit did not vary and remained at 26 psi throughout the turn but the cooling water pressure in the right propulsion unit dropped to 7 psi, which has been a longstanding problem in marine twin drives. The water pressure drop is due to the turning of the propulsion unit such that its cooling water intake turns more directly into the aerated water path from the unmodified strake with the vertical side surface such as 42. During straightline running, the right unmodified strake produced a variable water pressure which varied from 15 to 19 psi; while the left modified strake produced a constant water pressure which remained at 26 psi.

Further, it was observed that the water pressure in the left propulsion unit remained constant at 26 pounds per square inch in both left and right turns, which indicates that even when the water inlet port of such propulsion unit is turned more directly into the path behind its respective strake, there is only water and not air in such path. It has thus been found that the modified strake in accordance with FIG. 5 has minimized aerated water flowing into the propulsion unit intake ports, including during turns, and has solved the longstanding problem of overheating of the propulsion units in a twin drive.

It is recognized that various equivalents, alternatives and modifications are possible within the scope of the appended claims.

I claim:

1. A boat, comprising a hull including a bottom and having a centerline extending longitudinally along said bottom, a pair of strakes extending longitudinally along said bottom and spaced laterally outwardly from and on opposite sides of said centerline, each strake composed of a generally horizontal first surface extending laterally outward from said bottom and a second surface interconnecting said first surface and said bottom and extending upwardly and laterally outward from said first surface at an acute angle to the vertical and occupying the space otherwise adjacent a vertical side surface of the strake which would otherwise provide a low pressure region forming a path along such otherwise vertical strake side surface along which air can otherwise enter at the water surface when the boat is running and follow such low pressure path rearwardly resulting in ingestion of aerated water, said second surface extending from said first surface laterally upwardly and outwardly to said hull bottom at a sufficient angle relative to vertical to occupy said space and eliminate said low pressure path and ingestion of air.

2. In combination, a boat hull having a transom disposed at the stern end of said hull, said hull including a bottom surface and having a centerline extending longitudinally along said bottom surface, a pair of strakes extending longitudinally along said hull and spaced laterally outward and on opposite sides from said centerline, each strake composed of a generally horizontal first surface extending laterally outward from said bottom surface and said bottom surface interconnecting said first surface and said bottom surface and extending upwardly and laterally outward from said first surface at an acute angle to the vertical, and a pair of propulsion units disposed on said transom and spaced laterally on opposite sides of said centerline, said propulsion units disposed in generally longitudinal alignment with respective said strakes, said second surface occupying the space otherwise adjacent a vertical side surface of the strake and which would otherwise provide a low pressure region forming a low pressure path along such otherwise vertical strake side surface along which air can otherwise enter at the water surface when the boat is running and follow such low pressure path longitudinally rearwardly to the respective said propulsion unit resulting in ingestion of aerated water and consequent overheating, said second surface extending from said first surface laterally upwardly and outwardly to said hull bottom surface at an acute angle relative to vertical to occupy said space and eliminate said low pressure path and ingestion of air in said respective propulsion unit, to prevent overheating.

3. In combination, a boat hull having a transom disposed at the stern end of said hull, said hull including a bottom surface and having a centerline extending longitudinally along said bottom surface, a pair of strakes extending longitudinally along said hull and spaced laterally outward and on opposite sides from said centerline, each strake composed of a generally horizontal first surface extending laterally outward from said bottom surface and a second surface interconnecting said first surface and said bottom surface and extending upwardly and laterally outward from said first surface at an acute angle to the vertical, and a pair of propulsion units disposed on said transom and spaced laterally on opposite sides of said centerline, said propulsion units disposed in generally longitudinal alignment with respective said strakes, wherein said strakes extend longitudinally rearwardly and stop at rear end spaced forwardly of said transom, and wherein said rear ends of said strakes are blended into said hull bottom surface to provide a nonabrupt transition and prevent cavitation and hence reduce ingestion of aerated water at said propulsion units and consequent overheating of the latter, whereby to provide improved cooling.

4. The invention according to claim 3 wherein is about 30°.

5. An improved cooling system for a marine drive having a propulsion unit at the rear of a boat having a hull with a pair of lifting strakes extending longitudinally along its bottom, each strake having a generally horizontal bottom surface extending laterally from the hull bottom, each strake having an upwardly sloped nonvertical side surface occupying the space otherwise adjacent a vertical side surface of the strake which would otherwise provide a low pressure region forming a path along such otherwise vertical strake side surface along which air can otherwise enter at the water surface when the boat is running and follow such low pressure path rearwardly to said propulsion unit resulting in ingestion of aerated water and consequent overheating, said nonvertical strake side surface extending from said strake bottom surface laterally upwardly and outwardly to the hull bottom at a sufficient angle relative to vertical to occupy said space and eliminate said low pressure path and ingestion of air in said propulsion unit, to prevent overheating.

6. In combination, a boat with a hull having at least a pair of lifting strakes extending longitudinally rearwardly along the bottom of the hull, said hull bottom being sloped laterally upwardly from a longitudinal centerline, said strakes being on opposite sides of said centerline, a propulsion unit at the rear of said boat and having a submerged propeller and having water intake ports for ingesting cooling water into said propulsion unit, each strake having a generally horizontal bottom surface for providing lift, said strake bottom surface extending laterally horizontally from said upwardly sloped hull bottom surface, each strake having an upwardly sloped nonvertical side surface occupying the space otherwise adjacent a vertical side surface of the strake and which would otherwise provide a low pressure region forming a low pressure path along such otherwise vertical strake side surface along which air can otherwise enter at the water surface when the boat is running and follow such low pressure path longitudinally rearwardly to said water intake ports of said propulsion unit resulting in ingestion of aerated water and consequent overheating, said nonvertical strake side surface extending from said strake bottom surface laterally upwardly and outwardly to said hull bottom surface at an acute angle relative to vertical to occupy said space and eliminate said low pressure path and ingestion of air in said water intake ports of said propulsion unit, to prevent overheating.

7. An improved cooling system for a marine twin drive having a pair of propulsion units at the rear of a boat having a hull with a pair of lifting strakes extending longitudinally along its bottom and generally longitudinally aligned with said propulsion units, each strake having a generally horizontal bottom surface extending laterally from the hull bottom, each strake having an upwardly sloped nonvertical side surface occupying the space otherwise adjacent a vertical side surface of the strake which would otherwise provide a low pressure region forming a path along such otherwise vertical strake side surface along which air can otherwise enter at the water surface when the boat is running and follow such low pressure path rearwardly to the respective said propulsion unit resulting in ingestion of aerated water and consequent overheating, said nonvertical strake side surface extending from said strake bottom surface laterally upwardly and outwardly to the hull bottom at a sufficient angle relative to vertical to occupy said space and eliminate said low pressure path and ingestion of air in said propulsion units, to prevent overheating.

8. In combination, a boat with a hull having at least a pair of lifting strakes extending longitudinally rearwardly along the bottom of the hull, said hull bottom being sloped laterally upwardly from a longitudinal centerline, said strakes being on opposite sides of said centerline, a pair of propulsion units at the rear of said boat on opposite sides of said centerline and having submerged propellers and having water intake ports for ingesting cooling water into said propulsion units, said water intake ports being generally longitudinally aligned with and rearward of said strakes, each strake having a generally horizontal bottom surface for providing lift, said strake bottom surface extending laterally horizontally from said upwardly sloped hull bottom surface, each strake having an upwardly sloped nonvertical side surface occupying the space otherwise adjacent a vertical side surface of the strake and which would otherwise provide a low pressure region forming a low pressure path along such otherwise vertical strake side surface along which air can otherwise enter at the water surface when the boat is running and follow such low pressure path longitudinally rearwardly to said water intake ports of said propulsion units resulting in ingestion of aerated water and consequent overheating, said nonvertical strake side surface extending from said strake bottom surface laterally upwardly and outwardly to said hull bottom surface at an acute angle relative to vertical to occupy said space and eliminate said low pressure path and ingestion of air in said water intake ports of said propulsion units, to prevent overheating.

* * * * *

UNITED STATES PATENT AND TRADEMARK OFFICE

CERTIFICATE OF CORRECTION

PATENT NO. : 4,790,783

DATED : December 13, 1988

INVENTOR(S) : MICHAEL A. KARLS

It is certified that error appears in the above-identified patent and that said Letters Patent is hereby corrected as shown below:

Col. 1, line 9, after "in" delete ","; Col. 3, line 2, delete "lo" and substitute therefor -- low --; Col. 3, line 5, after "FIG" delete "!" and substitute therefor -- . --; Col. 4, line 3, claim 2, delete "said bottom" and substitute therefor -- a second --; Col. 4, line 49, claim 4, after "wherein" insert -- said angle --.

Signed and Sealed this

Seventeenth Day of October, 1989

*Attest:*

DONALD J. QUIGG

*Attesting Officer*

*Commissioner of Patents and Trademarks*